US005689769A

United States Patent [19]

Appel et al.

[11] Patent Number: 5,689,769

[45] Date of Patent: Nov. 18, 1997

[54] SEMI-AUTOMATIC EXIT WINDOW CLEANER

[75] Inventors: James J. Appel, Rochester; Edward A. Powers, Penfield; Kenneth R. Ossman, Macedan, all of N.Y.

[73] Assignee: Xerox Corporation, Stamford, Conn.

[21] Appl. No.: 669,121

[22] Filed: Jun. 24, 1996

[51] Int. Cl.[6] ..... G03G 15/04

[52] U.S. Cl. ..... 399/98; 15/256.53; 399/393

[58] Field of Search ..... 399/99, 218, 98, 399/391, 393; 355/30; 15/250.351, 250.352, 256.5, 256.53

[56] References Cited

U.S. PATENT DOCUMENTS 3,958,877 5/1976 Menon et al. ..... 355/327

4,277,160 7/1981 Yamada ..... 347/122

5,089,850 2/1992 Ogura et al. ..... 355/215

*Primary Examiner*—Arthur T. Grimley

*Assistant Examiner*—Quana Grainger

*Attorney, Agent, or Firm*—John M. Kelly

[57] ABSTRACT

A semi-automatic exit window cleaner which includes a wiper for contacting an exit window. The wiper attaches to a wiper operation mechanism which swipes the wiper across the exit window when an operator accessed compartment or drawer is moved. Beneficially, the wiper mechanism is comprised of a cable which is spaced between two pulleys, one of which also connects to a gear or other rotation train.

4 Claims, 2 Drawing Sheets

SEMI-AUTOMATIC EXIT WINDOW CLEANER

FIELD OF THE INVENTION

This invention relates to maintaining image quality in electrophotographic marking machines which use raster scanners.

BACKGROUND OF THE INVENTION

Electrophotographic marking is a well known method of copying or printing documents or other substrates. Electrophotographic marking is typically performed by exposing a light image of an original document onto a substantially uniformly charged photoreceptor. That light image discharges the photoreceptor so as to create an electrostatic latent image of the original on the photoreceptor's surface. Toner particles are then deposited onto the latent image so as to form a toner image. That toner image is then transferred from the photoreceptor, either directly or after an intermediate transfer step, onto a marking substrate such as a sheet of paper. The transferred toner powder image is then fused to the marking substrate using heat and/or pressure. The surface of the photoreceptor is then cleaned of residual developing material and recharged in preparation for the creation of another image.

While many types of light exposure systems have been developed, a commonly used system is the raster output scanner (ROS). A raster output scanner is comprised of a laser beam source, a modulator for modulating the laser beam (which, as in the case of a laser diode, may be the source itself), such that the laser beam contains information that is to be created, a rotating polygon having at least one reflective surface, input optics that collimate the laser beam, output optics which focus the laser beam into a spot on a photoreceptor's surface and which corrects for various optical problems such as wobble, and, usually, one or more folding mirrors. The laser source, modulator, and input optics produce a collimated laser beam which is directed toward the polygon. As the polygon rotates the reflective surface(s) causes the laser beam to be swept along a scan plane. The swept laser beam passes through the output optics and is reflected by the mirror(s) so as to produce a sweeping spot on the charged photoreceptor and which traces a scan line across the photoreceptor. Since the charged photoreceptor moves in a direction which is substantially perpendicular to the scan line, the sweeping spot raster scans the photoreceptor. By suitably modulating the laser beam as the spot raster scans the photoreceptor a desired latent image can be produced on the photoreceptor.

To assist the understanding of the present invention several things about electrophotographic marking machines should be understood. The inner workings of a typical electrophotographic marking machine are rather dirty; excess toner particles, paper debris, and dust tend to collect within the machine. Because of dirt contamination various steps are taken to prevent degradation of the electrophotographic process. For example, the raster output scanner is usually enclosed in a compartment to protect it from the contaminants. In that case the enclosing compartment has an exit window, a glass window disposed between the raster output scanner and the photoreceptor, through which the laser beam can pass. While the inclusion of an exit window reduces contamination of the raster output scanner itself, the mobile nature of the contamination combined with the turbulent air flow around a moving photoreceptor, means that if left alone the exit window will eventually become coated with contaminants.

In the prior art, to prevent the exit window from being excessively contaminated field service personnel were instructed to clean the exit window at every service call. While that is beneficial, if the field service provider fails to clean the exit window, or if the machine does not require frequent service, excessive contamination could result.

While a fully automated exit window cleaner could be implemented, its cost would be excessive in low cost machines. Furthermore, automated exit window cleaners would have to be synchronized with nonprinting periods to prevent the cleaning mechanism from interfering with the printing process. Additionally, excessive cleaning could damage the exit window. Therefore, a low cost exit window cleaning system which does not interfere with printing and which does not occur so often that the exit window could be harmed would be beneficial.

SUMMARY OF THE INVENTION

The principles of the present invention provide for semi-automatic exit window cleaning. A semi-automatic cleaner according to the present invention is comprised of a wiper for contacting the exit window and a wiper operation mechanism which swipes the wiper across the exit window when an operator accessed compartment is moved or activated. Beneficially, the wiper mechanism is comprised of a cable which is spaced between pulleys and which is connected to a paper drawer. Beneficially the wiper is attached to the cable. Then, when the paper drawer is opened the wiper swipes the exit window in one direction, and when the drawer is pushed back into place the wiper swipes the exit window in the other direction.

BRIEF DESCRIPTION OF THE DRAWINGS

Various aspects of the present invention will become apparent as the following description proceeds and upon reference to the drawings, in which.

In the drawings, like numbers designate like elements. Additionally, the text includes directional signals which are taken relative to the drawings (such as fight, left, top, bottom, or side). Those directional signals are meant to aid the understanding of the present invention, not to limit it.

DETAILED DESCRIPTION OF THE PREFERRED EMBODIMENTS

Figure 1:
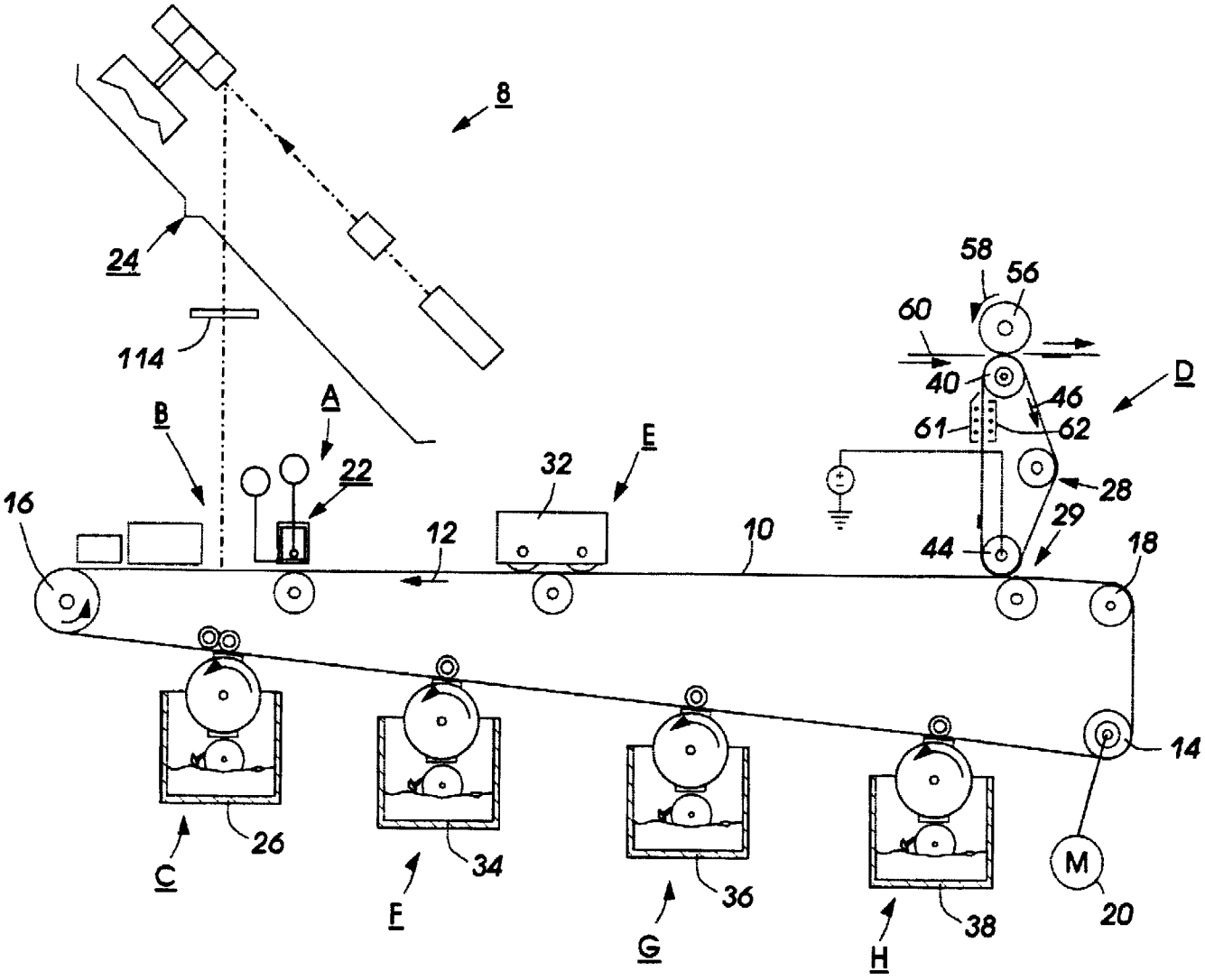
FIG. 1 schematically illustrates an electrophotographic printing machine which incorporates the principles of the present invention.

FIG. 1 illustrates an electrophotographic printing machine 8 that produces an original document. Although the principles of the present invention are well suited for use in such machines, they are also well suited for use in other printing devices. Therefore it should be understood that the present invention is not limited to the particular embodiment illustrated in FIG. 1 or to the particular application shown therein.

The printing machine 8 includes a charge retentive device in the form of an Active Matrix (AMAT) photoreceptor 10 which has a photoconductive surface and which travels in the direction indicated by the arrow 12. Photoreceptor travel is brought about by mounting the photoreceptor about a drive roller 14 and two tension rollers, the rollers 16 and 18, and then rotating the drive roller 14 via a drive motor 20.

As the photoreceptor moves each part of it passes through each of the subsequently described processing stations. For convenience, a single section of the photoreceptor, referred to as the image area, is identified. The image area is that part of the photoreceptor which is operated on by the various stations to produce toner layers. While the photoreceptor may have numerous image areas, since each image area is processed in the same way a description of the processing of one image area suffices to explain the operation of the printing machine.

As the photoreceptor 10 moves, the image area passes through a charging station A. At charging station A a corona generating scorotron 22 charges the image area to a relatively high and substantially uniform potential, for example about −500 volts. While the image area is described as being negatively charged, it could be positively charged if the charge levels and polarities of the other relevant sections of the copier are appropriately changed. It is to be understood that power supplies are input to the scorotron 22 as required for the scorotron to perform its intended function.

Figure 2:
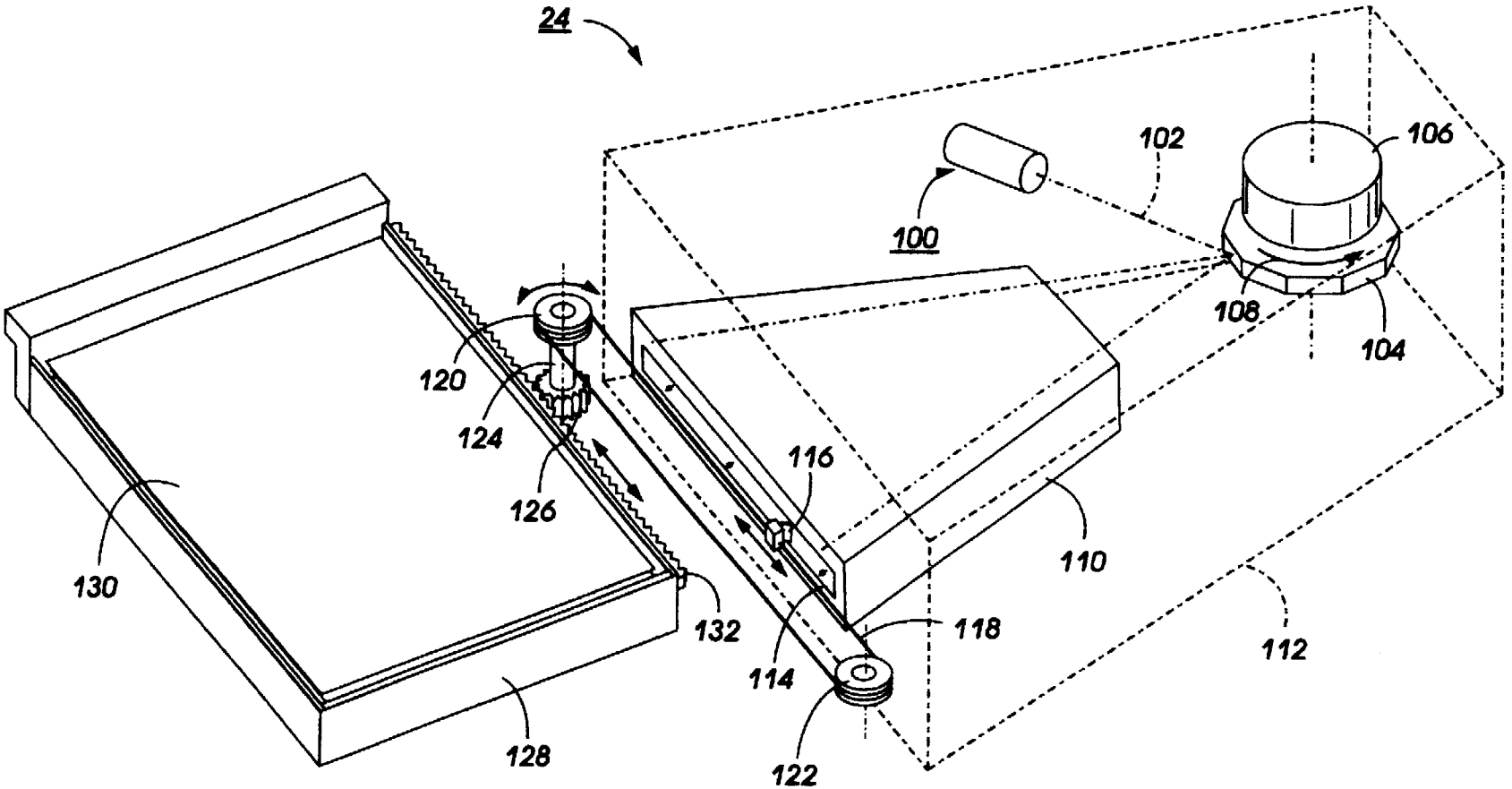
FIG. 2 is an illustration of one embodiment of an exit window cleaning system which is in accord with the principles of the present invention.

After passing through the charging station A the now charged image area passes to an exposure station B. At exposure station B the charged image area is exposed to the output of a laser based raster output scanning assembly 24 which illuminates the image area with a light representation of a first color image, say black. That light representation discharges some parts of the image area so as to create a first electrostatic latent image. Since the principles of the present invention specifically relate to the Exposure station B, the raster output scanning assembly 24 assembly, which is schematically depicted in FIG. 2, is described in more detail subsequently.

After passing through the exposure station B, the now exposed image area passes through a first development station C. At the first development station C a negatively charged development material 26, which is comprised of black toner particles, is advanced to the image area. The development material is attracted to the less negative sections of the image area and repelled by the more negative sections. The result is a first toner layer on the image area.

After passing through the first development station C the image area is advanced to a transfusing module D. That transfusing module includes a positively charged transfusing member 28, which may be a belt, as illustrated in FIG. 1, or a drum which forms a first nip 29 with the photoreceptor. That nip is characterized by a first pressure between the photoreceptor 10 and the transfusing member 28. The negatively charged toner layer on the photoreceptor is attracted onto the positively charged transfusing member.

After the first toner image is transferred to the transfusing member 28 the image area passes to a cleaning station E. The cleaning station E removes any residual development material remaining on the photoreceptor 10 using a cleaning brush contained in a housing 32.

After passing through the cleaning station E the image area repeats the charge-expose-develop-transfer-clean sequence for a second color of developer material (say yellow). Charging station A recharges the image area and exposure station B illuminates the recharged image area with a light representation of a second color image (yellow) to create a second electrostatic latent image. The image area then advances to a second development station F which deposits a second negatively charged development material 34, which is comprised of yellow toner particles, onto the image area so as to create a second toner layer. The image area and its second toner layer then advances to the transfusing module D where the second toner layer is transferred onto the transfusing member 28.

The image area is again cleaned by the cleaning station E. The charge-expose-develop-transfer-clean sequence is then repeated for a third color (say magenta) of development material 36 using development station G, and then for a fourth color 38 (cyan) of development material using development station H.

Turning our attention to the transfusing module D, the transfusing member 28 is entrained between a transfuse roller 40 and a transfer roller 44. The transfuse roller is rotated by a motor, which is not shown, such that the transfusing member rotates in the direction 46 in synchronism with the motion of the photoreceptor 10. The synchronism is such that the various toner images are registered after they are transferred onto the transfusing member 28

Still referring to FIG. 1, the transfusing module D also includes a backup roller 56 which rotates in the direction 58. The backup roller is beneficially located opposite the transfuse roller 40. The backup roller cooperates with the transfuse roller to form a second nip which acts as a transfusing zone. When a substrate 60 passes through the transfusing zone the toner layer on the compression layer is heated by a combination of heat from a radiant preheater 61 or from conductive heat from a conductive heater 62 and heat from the transfuse roller 40. The combination of heat and pressure fuses the composite toner layer onto the substrate.

As mentioned above, the raster output scanning assembly 24 is shown in more detail in FIG. 2. The raster output scanning assembly includes a laser assembly 100, beneficially comprised of a laser diode and a set of collimating optics, which outputs a laser beam 102. The laser beam is directed onto facets of a polygon 104, which is rotated by a polygon motor 106 in a direction 108. The laser beam 102 reflects off of the polygon facets as a sweeping beam. The sweeping beam passes through a set of output optics 110 which focuses the sweeping beam into a spot on the photoreceptor 10 (see FIG. 1) and which corrects for various optical errors (such as wobble).

The laser assembly 100, polygon 104, polygon motor 106 and output optics 110 are all sealed or otherwise protected from contamination by locating them in a container 112. An exit window 114 is located such that the sweeping laser beam which passes through the output optics 110 can be applied to the photoreceptor 10. The exit window 114 is an elongated piece of glass having a flat front surface which is exposed to the various contaminates within the machine. For convenience FIG. 2 shows the exit window at the front of the output optics.

The present invention relates to semiautomatic cleaning of the front surface. In practice, a soft, flexible wiper 116 is connected to a cable 118 which wraps around pulleys 120 and 122. One of the pulleys is attached to a rod 124 which also has a gear 126. The wiper 116, cable 118, pulleys 120 and 122, rod 124 and gear 126 are permanently affixed to the machine. The semiautomatic cleaner also includes a paper tray 128 for holding paper or other substrate material 130. The paper tray 128 has a rack gear 132 which mates with the gear 126 when the paper tray is in the machine. While the foregoing has described the use of a paper tray, other operator accessible element may also be used.

When the paper tray is fully in the machine the wiper 116 is at one end of the exit window such that the laser beam from the output optics is not blocked. Furthermore, the exit window, cable 118, and laser beam are designed such that the cable does not block the path of the laser beam during normal operation. However, when the paper tray needs to be refilled, the paper tray is pulled in one direction by an operator (or as a result of an operator initiated action). Motion of the rack gear 132 causes the gear 126, rod 124, and pulley 120 to rotate. This rotation in turn causes the cable 118 and the wiper 116 to rotate in one direction. This causes the wiper 114 to swipe the exit window, cleaning it. After the paper tray is filled, the tray is moved back into place. This causes the wiper to swipe the exit window in the other direction.

It is to be understood that while the figures and the above description illustrate the present invention, they are exemplary only. Others who are skilled in the applicable arts will recognize numerous modifications and adaptations of the illustrated embodiments which will remain within the principles of the present invention. For example, the use of gears is not required. Another variation of the present invention is to any other tray to initiate swiping or to use the opening of a door or other access panel to drive the wiper across the exit window. Therefore, the present invention is to be limited only by the appended claims.

What is claimed:

1. A semi-automatic exit window cleaner comprised of:

an exit window;

a wiper for contacting said exit window;

a movable mechanical coupling operatively connected to said wiper; and a drive mechanism attached to said mechanical coupling, said drive mechanism for moving said mechanical coupling when an operator moves an operator accessed element, wherein said moving of said mechanical coupling causes said wiper to swipe across said exit window;

wherein said operator accessed element is a substrate holding drawer.

2. A semi-automatic exit window cleaner according to claim 1, wherein opening of said drawer swipes the wiper across said exit window in a first direction, and wherein the closing of said drawer swipes the wiper across said exit window in a second direction.

3. A marking machine comprised of:

a photoreceptor having a photoconductive surface which moves in a process direction;

a charging station for charging said photoconductive surface to a predetermined potential;

a raster scanner assembly for exposing said photoconductive surface to produce a first electrostatic latent images on said photoconductive surface by sweeping a modulated laser beam across said photoreceptor in a fast scan direction which is substantially perpendicular to said process direction;

a first developing station for depositing developing material on said first electrostatic latent image so as to produce a first toner image on said photoconductive surface;

a transfer station for receiving said first toner image from said photoconductive surface and for transferring said first toner image onto a substrate; and a semi-automatic exit window cleaner, having:

an exit window optically disposed between said photoreceptor and said raster scanner assembly;

a wiper for contacting said exit window;

a movable mechanical coupling operatively connected to said wiper; and a drive mechanism attached to said mechanical coupling, said drive mechanism for moving said mechanical coupling when an operator moves an operator accessed element, wherein said moving of said mechanical coupling causes said wiper to swipe across said exit window;

wherein said operator accessed element is a substrate holding drawer.

4. A marking machine according to claim 3, wherein opening of said drawer swipes the wiper across said exit window in a first direction, and wherein the closing of said drawer swipes the wiper across said exit window in a second direction.

* * * * *